United States Patent [19]

Bachmann

[11] 3,992,920

[45] Nov. 23, 1976

[54] WEDGE PRESS

[75] Inventor: Horst Bachmann, Rodental, Germany

[73] Assignee: Langenstein & Schemann Aktiengesellschaft, Coburg, Germany

[22] Filed: Dec. 11, 1975

[21] Appl. No.: 639,887

Related U.S. Application Data

[63] Continuation of Ser. No. 476,590, June 5, 1974, abandoned.

[30] Foreign Application Priority Data

June 8, 1973 Germany ..... 2329323
June 8, 1973 Germany ..... 2329324

[52] U.S. Cl. ..... 72/452; 72/454; 72/456; 100/289; 100/291

[51] Int. Cl.[2] ..... B21J 9/18

[58] Field of Search ..... 72/452, 454, 456; 100/291, 289

[56] References Cited

UNITED STATES PATENTS

| | | | |
|---|---|---|---|
| 764,096 | 7/1904 | Williams | 100/291 |
| 3,122,033 | 2/1964 | Riemenschneider | 100/291 |
| 3,139,816 | 7/1964 | Jemison | 100/266 |
| 3,580,794 | 5/1971 | Mintz | 100/291 |
| 3,743,469 | 7/1973 | Gibbons | 100/271 |
| 3,844,157 | 10/1974 | Bachmann | 100/291 |

FOREIGN PATENTS OR APPLICATIONS

| | | | |
|---|---|---|---|
| 7,550 | 1838 | United Kingdom | 100/291 |

*Primary Examiner*—C.W. Lanham
*Assistant Examiner*—Gene P. Crosby
*Attorney, Agent, or Firm*—Holman & Stern

[57] ABSTRACT

A wedge press is provided with a press frame; a reciprocatingly displaceable ram; a reciprocatingly displaceable wedge for acting on the ram; and means for effecting displacement of the wedge to cause the wedge to act upon the ram and thereby to effect displacement of the ram, with the wedge and the press frame having a pair of mutually engaging contact surfaces and the wedge and the ram having a pair of mutually engaging contact surfaces, and at least one said pair of mutually engaging contact surfaces having a special configuration to provide improved guiding of the wedge.

4 Claims, 10 Drawing Figures

WEDGE PRESS

This is a continuation of application Ser. No. 476,590, filed June 5, 1974, now abandoned.

BACKGROUND OF THE INVENTION

The present invention relates to a wedge press incorporating improved guiding of the wedge, wherein a reciprocatingly displaceable wedge acted upon by an entraining mechanism acts on a reciprocatingly displaceable ram, with the wedge and the ram having mutually-engaging thrust-bearing contact surfaces at one side of the wedge and the wedge and the ram having mutually engaging thrust bearing contact surfaces at the opposite side of the wedge.

Presses of this nature act, for example, as forging presses or impact presses and are preponderantly intended at this time for deforming metal. The wedge is commonly displaced by means of a crank, a piston-cylinder system or a flywheel-spindle arrangement. As a rule, the wedge is situated above the ram. It is envisaged, however, to position the wedge beneath the ram if the ram is upwardly and downwardly displaceable, or to arrange the wedge and ram side-by-side, with the ram then concomitantly moving reciprocatingly in a horizontal direction. In the case of presses of the kind specified in the foregoing, which have been known until now, the thrust-bearing contact surfaces of the wedge on the one hand and the press frame or ram on the other hand, are planar and lateral guides are incorporated between the wedge and press frame. The contact surface between the wedge and the ram, moreover, extends at right angles to the ram guiding system within the press frame, whereas the contact surface between the wedge and the press frame is angled with respect to the ram guide, i.e. has an angle differing from 90°.

If the wedge thrusts the ram forward for deformation of material within dies and the dies are not centrally positioned with respect to the ram, the ram will undergo canting, which in its turn results in canting of the wedge. Its elimination is intended, e.g. by means of lateral guides for the wedge. Quite generally, the wedge must be prevented from twisting, in the case of a wedge press, around an axis parallel to its slope, from turning around an axis extending in the direction of the ram displacement and from being displaced in a direction at right angles to the ram displacement and the required wedge displacement.

OBJECTS AND SUMMARY OF THE INVENTION

Accordingly, it is an object of the invention to prevent or reduce twisting, displacing and canting movements of the wedge. If the wedge is moved back and forth on the ram, a frictional force which must be borne by the ram guides situated at the front and rear of the wedge, acts on the ram in the area of the contact surface of the wedge and ram.

Accordingly, it is another object of the invention to reduce the stress on the ram guiding system. The invention proposes a wedge press of the kind defined in the foregoing, wherein the improved guiding action is obtained by a special configuration of at least one of the contact surfaces.

In one preferred form, the invention consists of a wedge press comprising a system for the prevention of undesirable displacements of a reciprocatingly movable wedge, which is preferably acted upon centrally by an entraining system, and which acts on a reciprocatingly displaceable ram which may have stress imposed thereon by eccentrically positioned dies, the wedge and the ram having mutually-engaging thrust-bearing contact surfaces at one side, with the ram and the wedge and the press frame having mutually-engaging thrust-bearing contact surfaces at the opposite side; at least the thrust-bearing contact surfaces of the press frame and the wedge form at least one depression of ridge-like or trough-like form in cross-section, and extending in the direction of displacement whereof the cross-section diminishes in the direction of displacement of the ram.

By virtue of the ridge-like or trough-like configuration of the contact surface, the wedge is always prevented from describing even the least undesirable twisting and sliding movement, because the press force forces the wedge directly between the two side walls of the depression leaning towards each other. In the case of the wedge press according to the invention, there is no play between the wedge and the press frame, so that it is possible to omit lateral guides for the wedge on the press frame, thereby reducing structural complexity. The design of the wedge unit is simplified.

In the case of a wedge press according to the invention, no more than one ridge-like or trough-like depression whereof the cross-section extends throughout the width or almost throughout the width of the wedge is situated at one contact surface. It is also possible, however, to incorporate several depressions, preferably two depressions, beside each other, which cover the width of the wedge. The cross-section of the depression may be triangular or semi-circular, for example. A depression may also be situated at the contact surface between the ram and the wedge. The depression may be formed within the wedge or in the press frame or ram.

A single depression only is preferably incorporated, because the production costs are then low, while nevertheless securing the desirable action to its fullest extent. Preferably, the depression extends throughout the width of the wedge. In this form of embodiment, the thrust-bearing contact surface lacks a component portion extending horizontally, i.e. at right angles to the direction of ram displacement, which not only implies advantages in respect of production technique, but in particular precludes any play between the wedge and the press frame or rather ram.

The cross-section of the depression is preferably triangular. The triangular shape of the depression is not only particularly advantageous in respect of production technique, but also prevents unwanted wedge displacement in particular degree and plays a part in the total elimination of play in the area of the contact surfaces.

The action sought is obtained to an increasingly satisfactory extent, as the maximum depth of the depression increases. It is appropriate for the maximum depth of the depression to be chosen equal to or greater than one third of the maximum width of the depression formed by the contact surface. If the depression is partially circularly shaped in cross-section, the depth may not exceed half the width. If the depression is triangular in cross-section, the angle formed in the depression should be specified as 100° if it is intended to secure optimum conditions in respect of production technique, although an internal angle of 90° is more advantageous in respect of prevention of undesirable displacements of the wedge.

In another preferred form, the invention consists in a wedge press comprising a system for reducing the stress on a ram guide system for the ram impelled by the wedge, wherein the wedge is guided on a surface of a press frame with a contact surface which subtends a guiding surface angle differing from 90° with the ram guiding system and is inclined towards the ram, with the wedge and the ram having mutually-engaging contact surfaces, and the contact surfaces of the wedge and the ram sloping with respect to the ram guiding system in the same direction as the contact surfaces of the wedge and the press frame but at an angle which is greater as compared to the guiding surface angle.

In the case of a press of this nature, the front and rear ram guides are relieved of stress when the wedge and the ram are advanced to perform a deforming stroke. During retraction of the wedge, the ram may well also be thrust against the ram guide, which is negligible, however, as compared to the lead of the ram guides during the deforming stroke. The decrease of the load on the ram guides is accomplished in an uncomplicated manner in accordance with the invention, since only a little machining is required on the ram and on the sole wedge acting on the same, in order to produce the slight inclination of the contact surface between the wedge and the ram.

The wedge exerting a thrust on the ram and sliding forward during a deforming stroke, then exerts a force on the ram not only in view of the friction which tends to thrust the ram against the front ram guide, but in view of the inclination of the contact surface between the wedge and the ram, also a force which prevents the ram from being thrust against the front ram guide or rather from being canted. The angle of inclination of the contact surface between the wedge and the ram preferably corresponds to 90° minus the angle of friction $\rho$, i.e. the contact surface preferably forms the angle of friction $\rho$ with a line at right angles to the ram guide.

The angle of friction $\rho$ is a concept known in technology, and expresses the friction between two elements thrust against each other, caused if the two elements are displaced with respect to each other. The angle of friction $\rho$ may be calculated for the case in question, or it may be determined by tests. In the case of the invention, the angle of friction $\rho$ is determined on the premise that the contact surface between the wedge and the ram extends at right angles to the ram guide. The contact surface is then produced at an inclination corresponding to the angle of friction $\rho$ determined. The inclination of the contact surface between the press frame and the wedge, i.e. the transmission ratio of the wedge, does not affect the inclination required between the wedge and the ram. For a particular transmission ratio, and in the case of a wedge press according to the invention, the angle of inclination of the contact surfaces of the press frame and the wedge is greater by an angle of inclination of the contact surface between the wedge and the ram, than in the case of a wedge press wherein the contact surface of the wedge and the ram is not inclined. If a particular transmission ratio of the wedge, and a particular inclination of the contact surfaces of the wedge and ram are desirable, the inclination of the contact surface between the press frame and wedge should be selected accordingly.

Some presses embodying the invention are described below with reference to the accompanying drawings, wherein

DETAILED DESCRIPTION OF THE EMBODIMENTS

Figure 1:
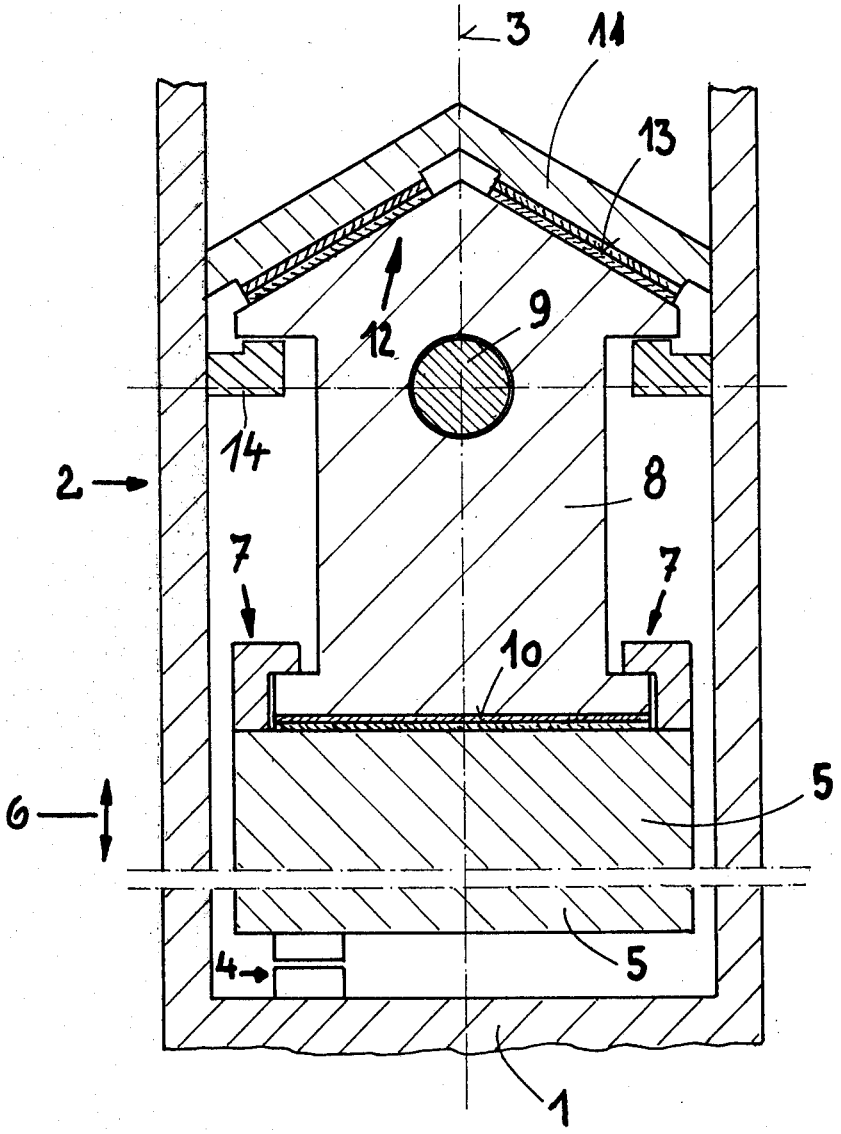
FIG. 1 shows a cross-section through an upright spindle-wedge press.

Referring to FIG. 1, an upright spindle-wedge press comprises a press frame 2 having an abutment 1 constituting a stationary anvil. A two-piece forging die 4 consists of one piece standing on the abutment 1 and another piece secured on a ram 5. The ram 5 is reciprocatingly displaceable in the direction of an arrow 6. The die 4 is offset from a vertically extending central axis 3. The ram 5 is connected to a wedge 8 by means of lateral horizontal guides 7 disposed on a side of the ram remote from the die 4. The press also comprises a supporting system 14 for the wedge 8. The supporting system may bear the weight of the ram, the wedge, a tool, and other parts of the press may come into action if a resistance against reaction is operative in the tool during upward movement of the ram. Along the horizontal guides 7, the wedge 8 is connected to a spindle 9 of a sloping flywheel-spindle system which acts centrally on the wedge and is not shown in detail. The ram 5 and the wedge 8 bear against each other over mutually-engaging thrust-bearing contact surfaces 10 which lie in a plane at right angles to the central axis 3. The wedge 8 is disposed between a frame element 11 of the press frame 2 and the ram 5. The wedge 8 bears displaceably on the frame element 2. The press is otherwise constructed like the press in accordance with German Offenlegusschrift Specification 2,007,505, with the height of the wedge varying in the direction of displacement, i.e. in a direction which extends at right angles to the plane of FIG. 1.

A recessed portion or depression 12 is formed in the frame member 11. Depression 12 is of triangular cross-section. Mutually-engaging thrust-bearing contact surfaces 13 of the frame member 11 and the wedge 8 extend in the direction of displacement of the wedge. The surface of the wedge 8 directed towards the frame member 11 is a protruding portion and constitutes the contact surface 13 of the wedge 8 and fits into the depression 12. The cross-section of the depression 12 is symmetrical with respect to the central axis 3. The portions of the contact surfaces 13 situated to the left of the central axis 3 are thus mirror images of the portions situated to the right of the central axis.

Figure 2:
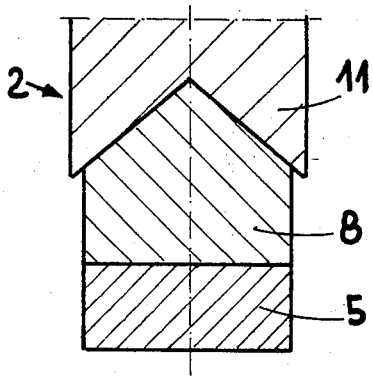
FIGS. 2–9 show press frame — wedge — ram arrangements with depressions shaped in different forms in the thrust-bearing contact surfaces.

FIG. 2 shows a diagrammatic cross-section through the press shown in FIG. 1 in the same plane as FIG. 1. As can be seen from FIGS. 1 and 2, the configurations of the contact surfaces of the wedge, the ram and the press frame are such that they form only one depression, namely the depression 12, and that depression is formed in the press frame.

Each of FIGS. 3 to 9 show a disgrammatic cross-section, similar to that of FIG. 2, through a respective press. Each press shown in FIGS. 3 to 9 is like that shown in FIGS. 1 and 2 except as described below. Except where otherwise stated, mutually-engaging contact surfaces of the ram and the wedge and of the wedge and the press frame are planar.

Figure 3:
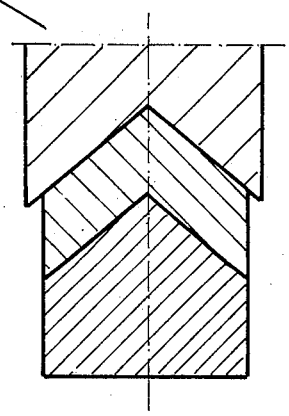

In the press shown in FIG. 3, the contact surfaces form a single depression of triangular cross-section in the press frame and a single depression of triangular cross-section in the wedge. The wedge projects into the depression in the press frame and the ram projects into the depression in the wedge.

Figure 4:
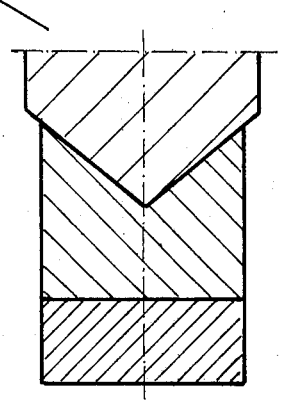

In the press shown in FIG. 4, the contact surfaces form a single depression in the wedge, into which depression the press frame projects, the depression being of triangular cross-section.

Figure 5:
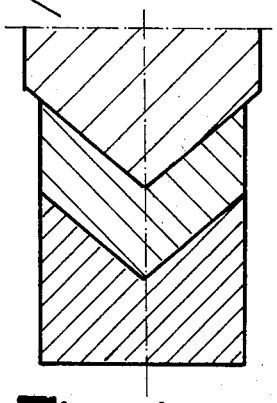

In the press shown in FIG. 5, the contact surfaces form a single depression of triangular cross-section in the wedge and a single depression of triangular cross section in the ram. The press frame projects into the depression in the wedge and the wedge projects into the depression in the ram.

Figure 6:
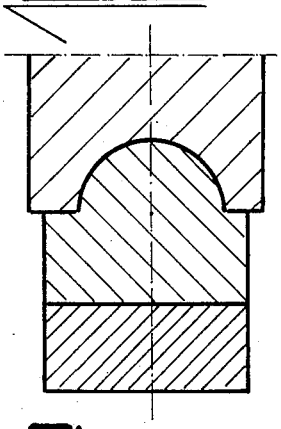

In the press shown in FIG. 6, the contact surfaces form a single depression of semi-circular cross-section in the press frame and the wedge projects into the depression.

Figure 7:
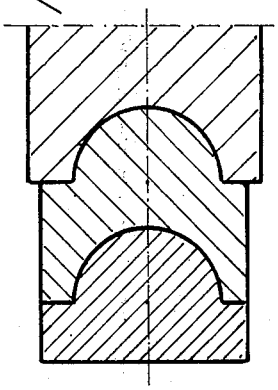

In the press of FIG. 7, the contact surfaces form a single depression of semi-circular cross-section in the press frame and a single depression of semi-circular cross-section in the wedge. The wedge projects into the depression in the press frame and the ram projects into the depression in the wedge.

Figure 8:
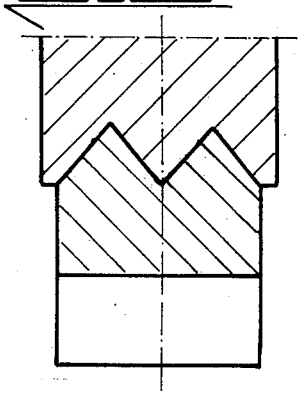

In the press of FIG. 8, the contact surfaces form two parallel depressions of triangular cross-section in the press frame and the wedge projects into the depressions.

Figure 9:
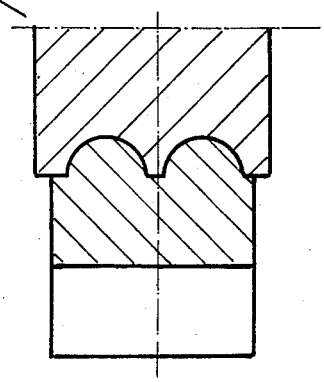

The press of FIG. 9 is like that of FIG. 8 except that the depressions, instead of being of triangular cross-section are of semi-circular cross section.

Figure 10:
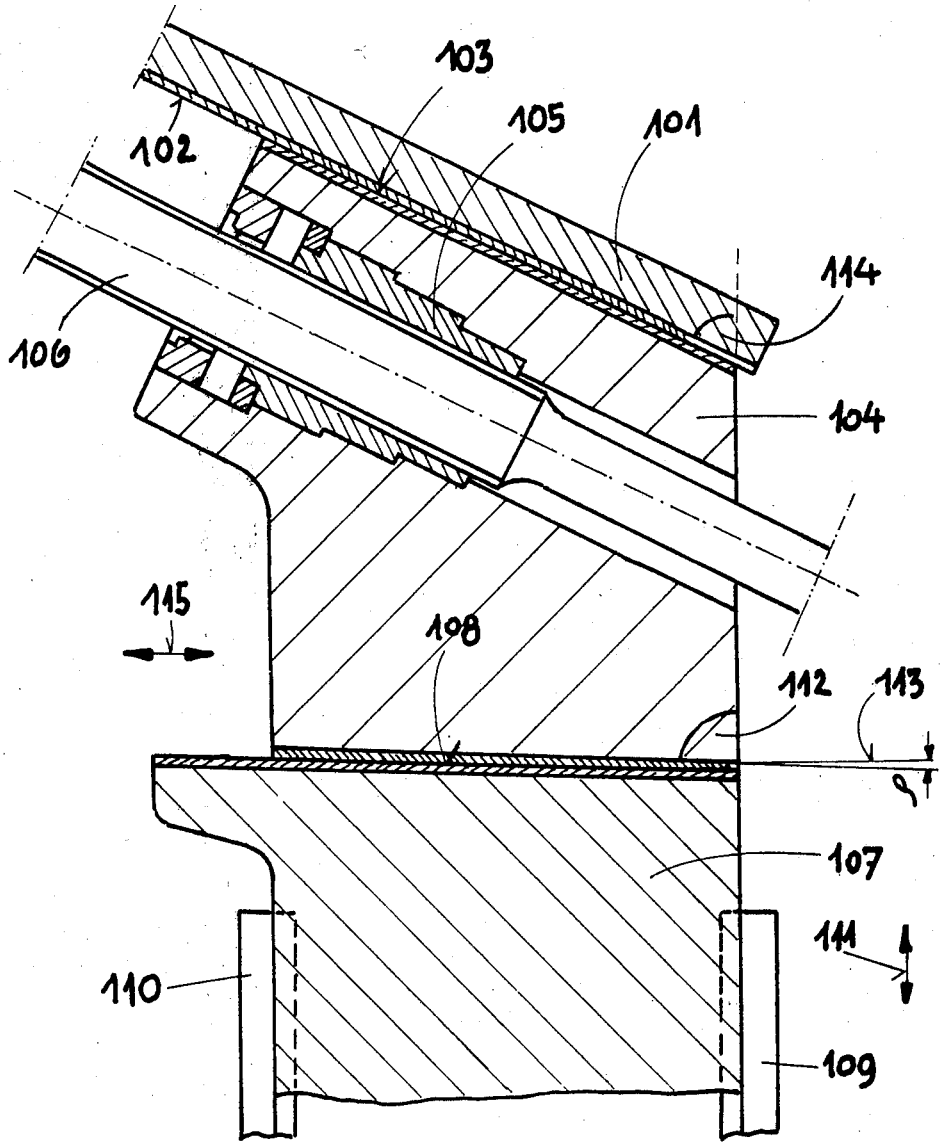
FIG. 10 shows a cross-section through an upright spindle-wedge press.

FIG. 10 diagrammatically shows a press similar to the press described in German Offenlegunsschrift Specification 2,007,505. The press comprises a press frame, not illustrated in detail having a press head 101 which on its underside has a surface 102 against which bears a guiding surface 103 of a wedge 104. In the wedge 104 is situated a spindle nut 105 wherein is rotatable, a spindle 106 of a flywheel-spindle arrangement not shown in detail. Beneath the wedge 104 is a ram 107 on which the wedge bears, with the wedge and the ram having mutually engaging contact surfaces 108. The ram 107 is guided in ram guides which are situated on the press frame and which include a front ram guide 109 and a rear ram guide 110.

The ram guides 109, 110 are straight and extend parallel to each other. The ram 107 is reciprocatingly displaceable in the ram guides in the directions indicated by arrow 111. The contact surfaces 108 are at an angle 112, which is smaller than 90°, to the arrow 111 and, accordingly the ram guides 109. A line 113 at right angles to the ram guide 109 makes an angle of $\rho$ with the contact surfaces 108, with the angle $\rho$ corresponding to the angle of friction between the ram 107 and the wedge 104. An imaginary rectilinear extension of the ram guide 109 makes an angle 114 with the guiding surfaces 102, the angle 114 being smaller than 90° and smaller than the angle 112. In operation of the press, the wedge 104 is displaced back and forth laterally in the directions of arrow 115, and is also displaced reciprocatingly in the direction of the arrow 111 which is at right angles to the arrow 115.

I claim:

1. A wedge press comprising: a press frame member; a reciprocatingly displaceable ram member; a reciprocatingly displaceable wedge member for acting on the ram member; and means for effecting displacement of the wedge member to cause the wedge to act upon the ram member and thereby to effect displacement of the ram member, the wedge member and the press frame member having a pair of mutually contact contact surfaces and the wedge member and the ram member having a pair of mutually engaging contact surfaces, at least one of said pair of mutually engaging contact surfaces having a protruding portion on one member and a recess portion in the other member shaped to provide non-linear contact and improved guiding of the wedge member, the recess portion being defined by at least one trough-like depression, and the depression extending across the entire width of the wedge member.

2. A wedge press comprising: a press frame member; a reciprocatingly displaceable ram member; a reciprocatingly displaceable wedge member for acting on the ram member; and means for effecting displacement of the wedge member to cause the wedge to act upon the ram member and thereby to effect displacement of the ram member, the wedge member and the press frame member having a pair of mutually engaging contact surfaces and the wedge member and the ram member having a pair of mutually engaging contact surfaces, at least one of said pair of mutually engaging contact surfaces having a protruding portion on one member and a recess portion in the other member shaped to provide non-linear contact and improved guiding of the wedge member, the recess portion being defined by at least one trough-like depression, and the depression being triangular in cross section.

3. A wedge press comprising: a press frame member; a reciprocating displaceable ram member; a reciprocatingly displaceable wedge member for acting on the ram member; and means for effecting displacement of the wedge member to cause the wedge to act upon the ram member and thereby to effect displacement of the ram member, the wedge member and the press frame member having a pair of mutually engaging contact surfaces and the wedge member and the ram member having a pair of mutually engaging contact surfaces, at least one of said pair of mutually engaging contact surfaces having a protruding portion on one member and a recess portion in the other member shaped to provide non-linear contact and improved guiding of the wedge member, the mutually engaging contact surfaces of the wedge member and the press frame member being at an angle differing from 90° to the direction of displacement of the ram member and the mutually engaging contact surfaces of the ram member and the wedge member being inclined with respect to the direction of the displacement of the ram member and in the same direction as the mutually engaging contact surfaces of the wedge member and the press frame member but an angle greater than the first-mentioned angle.

4. A wedge press comprising: a press frame member; a reciprocatingly displaceable ram member; a reciprocatingly displaceable wedge member for acting on the ram member; and means for effecting displacement of the wedge member to cause the wedge to act upon the ram member and thereby to effect displacement of the ram member, the wedge member and the press frame member having a pair of mutually engaging contact surfaces and the wedge member and the ram member having a pair of mutually engaging contact surfaces, wherein the mutually engaging contact surfaces of the wedge member and the press frame member are at an angle differing from 90° to the direction of displacement of the ram member and the mutually engaging contact surfaces of the ram member and the wedge member are inclined with respect to the direction of the displacement of the ram member and in the same direction as the mutually engaging contact surfaces of the wedge member and the press frame member but an angle greater than the first-mentioned angle.

* * * * *